US008308030B2

(12) United States Patent
Drugeon et al.

(10) Patent No.: US 8,308,030 B2
(45) Date of Patent: Nov. 13, 2012

(54) ASSEMBLY WHICH FORMS A PRODUCT DISPENSING HEAD AND WHICH IS CAPABLE OF BEING FITTED TO A BOTTLE

(75) Inventors: Lionel Drugeon, La Garenne Colombes (FR); Thierry Ponton, Maisons Alfort (FR); Vincent Riedinger, Bois D'Arcy (FR); Stéphane Maire, Bry sur Marne (FR); Sylvain De Raemy, Bezons (FR); Julien Sickersen, Aubergenville (FR)

(73) Assignee: L'Oreal, Paris (FR)

( * ) Notice: Subject to any disclaimer, the term of this patent is extended or adjusted under 35 U.S.C. 154(b) by 631 days.

(21) Appl. No.: 12/493,388

(22) Filed: Jun. 29, 2009

(65) Prior Publication Data

US 2010/0012681 A1 Jan. 21, 2010

Related U.S. Application Data

(60) Provisional application No. 61/076,953, filed on Jun. 30, 2008.

(30) Foreign Application Priority Data

Aug. 7, 2008 (FR) ..... 08 55468
Jan. 6, 2009 (FR) ..... 09 50044

(51) Int. Cl.
*B65D 88/54* (2006.01)
*B67D 7/58* (2010.01)

(52) U.S. Cl. ..... 222/321.7; 222/321.8; 222/321.1; 222/383.1; 215/272; 215/274

(58) Field of Classification Search .... 222/321.1–321.9, 222/383.1, 385; 215/272, 274
See application file for complete search history.

(56) References Cited

U.S. PATENT DOCUMENTS

| | | | | |
|---|---|---|---|---|
| 6,253,941 | B1 * | 7/2001 | VanBrocklin et al. | 215/274 |
| 7,575,132 | B2 * | 8/2009 | Stuart et al. | 222/383.1 |
| 7,857,174 | B2 * | 12/2010 | Michaux et al. | 222/507 |
| 7,874,465 | B2 * | 1/2011 | Bertin et al. | 222/402.12 |
| 2005/0061834 | A1 * | 3/2005 | Garcia et al. | 222/321.7 |
| 2008/0035679 | A1 * | 2/2008 | Lompech et al. | 222/321.9 |

* cited by examiner

*Primary Examiner* — Kevin P Shaver
*Assistant Examiner* — Nicholas Weiss
(74) *Attorney, Agent, or Firm* — Connolly Bove Lodge & Hutz LLP

(57) ABSTRACT

An assembly for a bottle which includes a neck with a vertical axis, which neck has a shoulder. The assembly includes a ring which is capable of being engaged around the neck and which includes profiles for retention on the neck which are capable of co-operating with the shoulder. The assembly further includes a fixed insert which is capable of being fitted to the bottle and which delimits a housing for receiving the ring. Opposing surfaces of the ring and the housing include complementary protruding and recessed fastening profiles for resilient engagement of the complementary profiles, at least two successive profiles on the ring or the housing allowing the ring to be fastened in at least two positions which are axially offset relative to the housing.

13 Claims, 5 Drawing Sheets

ASSEMBLY WHICH FORMS A PRODUCT DISPENSING HEAD AND WHICH IS CAPABLE OF BEING FITTED TO A BOTTLE

BACKGROUND OF THE INVENTION

1. Field of the Invention

The present invention relates to an assembly which is capable of being fitted to a bottle having a vertical axis in order to form a dispensing head for a product, in particular a cosmetic composition, contained in the bottle.

2. Discussion of the Background

It relates in particular to an assembly for a bottle which comprises a neck with a vertical axis, which neck has a shoulder, the assembly comprising:

- a ring which is capable of being engaged around the neck and which comprises profiles for retention on the neck which are capable of co-operating with the shoulder,
- a fixed insert which is capable of being fitted to the bottle and which delimits a housing for receiving the ring.

It is known to package perfumes, or other cosmetic compositions, in glass bottles which have, at the upper end thereof, a neck which is provided with an outer collar to which the dispensing head is fixed. The dispensing head is formed from another material, in particular a plastics material. This dispensing head may form a simple decorative hoop or carry a dispensing pump in order to take up the product which is contained in the bottle. The dispensing head may also comprise a control member which can be moved relative to a component which is fixed to the bottle, the control member being capable of activating a pump which has been retained beforehand by means of crimping around the neck of the bottle.

In order to mount the dispensing head on the bottle, it is known to interpose a ring which is capable of being engaged around the neck between the fixed body of the dispensing head, also referred to as the fixed insert, and the neck itself. The ring comprises profiles for retention on the neck which are capable of co-operating with a shoulder which is delimited below a collar which is provided at the end of the neck. The fixed insert delimits a housing for receiving the ring in which the ring is confined so that the profiles for retaining the ring on the neck are immobilised, making it impossible to release them.

The retention of the fixed insert on the ring is provided by means of friction. This is particularly the case for the arrangements described in documents EP 653 359, FR 2 897 851 and FR 2 856 994.

In other assemblies, described in particular in documents U.S. Pat. No. 4,773,553, U.S. Pat. No. 5,762,238 and FR 2 469 356, the retention of the insert on the ring is provided by means of resilient engagement owing to complementary profiles provided on the ring and the insert. This resilient engagement defines the relative position between the ring and the insert and consequently between the bottle and the head which is fitted to the bottle.

The arrangements described in this document are unsatisfactory in so far as, when the retention of the insert on the ring is provided by means of friction, it is necessary for the ring and the insert to have very precise manufacturing tolerances and the retention is not very reliable.

When the retention is provided by means of resilient engagement, the position of the insert on the bottle is predefined with the result that unsightly gaps are formed between the dispensing head and the bottle, owing to the significant manufacturing tolerances of the bottle which, since it is made from glass, cannot be produced with very precise dimensions.

SUMMARY OF THE INVENTION

The object of the invention is to provide a dispensing head which can be mounted in a reliable manner on a bottle and which allows the unsightly gaps to be eliminated between the dispensing head and the bottle.

To this end, the invention relates to an assembly for a bottle of the above-mentioned type, characterised in that the opposing surfaces of the ring and the housing comprise complementary protruding and recessed fastening profiles for resilient engagement of the complementary profiles, at least two successive profiles on the ring or the housing allowing the ring to be fastened in at least two positions which are axially offset relative to the housing.

According to specific embodiments, the assembly comprises one or more of the following features:

- at least one of the opposing surfaces of the ring and the housing comprises multiple horizontal grooves in order to carry out assembly by means of co-operation of the opposing surfaces absorbing the production tolerances of the bottle by positioning the grooves in accordance with the axial clearances owing to the travel between the ring and the fixed insert;
- it comprises a control member which can be moved relative to the insert and which is capable of co-operating with a dispensing member with which the bottle is provided;
- before mounting on the bottle, the ring is engaged in the housing of the insert and it comprises a profile for retaining the ring in position in the insert;
- the complementary fastening profiles comprise, on the outer surface of the ring, at least two successive grooves;
- the retention profiles comprise flaps which are distributed at the periphery of the ring and which are each capable of engaging against the shoulder;
- the grooves of the ring are discontinuous and extend over the flaps;
- the complementary fastening profiles comprise, on the fixed insert, at least two grooves;
- the pitches between the grooves of the ring and the insert are multiple integers of each other;
- the grooves are delimited between successive ribs which protrude relative to a generally smooth reference surface; and
- the grooves are delimited by inclined flanks which form an inclined portion in accordance with the direction in which the ring is inserted into the insert.

The invention also relates to an assembly for a bottle which comprises a neck with a vertical axis, which neck has a shoulder, the assembly comprising:

- a ring which is capable of being engaged around the neck and which comprises profiles for retention on the neck which are capable of co-operating with the shoulder,
- a fixed insert which is capable of being fitted to the bottle and which delimits a housing for receiving the ring, characterised in that at least one of the opposing surfaces of the ring and the housing comprises multiple horizontal grooves in order to produce an assembly by means of co-operation of the opposing surfaces absorbing the manufacturing tolerances of the bottle by positioning the grooves in accordance with the axial clearances owing to the travel between the ring and the fixed insert.

This assembly may further comprise any one of the characteristics defined above.

In this assembly, it is not necessary for the opposing surfaces of the ring and the housing to comprise complementary protruding and recessed fastening profiles for resilient engagement of the complementary profiles, at least two successive profiles on the ring or the housing allowing the ring to be fastened in at least two positions which are axially offset relative to the housing.

The invention also relates to a packaging which comprises a bottle and an assembly as defined above which is fitted to the bottle.

BRIEF DESCRIPTION OF THE DRAWINGS

The invention will be better understood from a reading of the following description, given purely by way of example and with reference to the drawings, in which.

DETAILED DESCRIPTION OF THE PREFERRED EMBODIMENTS

Figure 1:
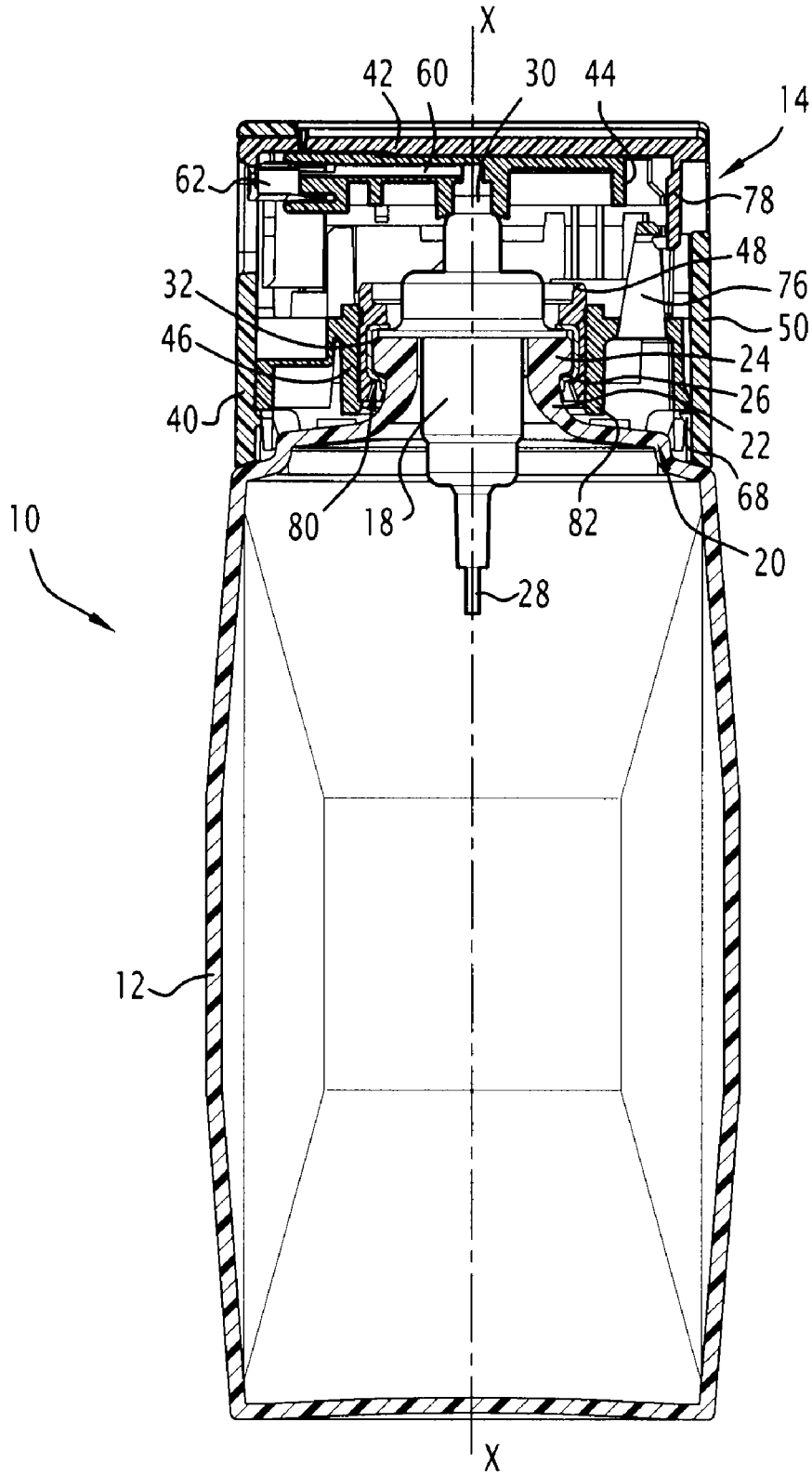
FIG. 1 is a longitudinal section of a packaging according to the invention.

The packaging 10 illustrated in FIG. 1 is, for example, a packaging for a perfume or any other cosmetic product such as a cream or a lotion.

It substantially comprises a glass bottle 12 over which there is fitted a constituent fitted assembly of a dispensing head 14. The dispensing head allows the control of a dispensing member 18 which is formed, for example, by a pump, this member being permanently mounted on the bottle 12. The bottle may also be produced from plastics material, for example, by means of injection blow-moulding.

The bottle 12 generally has a vertical axis X-X. It has, at the upper end thereof, a shoulder part 20 which is extended with a neck 22 which is arranged along the axis X-X. The neck has an outer end collar 24 which delimits, opposite the shoulder part 20, a shoulder 26 which allows the dispensing head 14 to be mounted. The bottle is produced by means of glass moulding and has quite significant production tolerances in particular with respect to the axial dimension between the shoulder part 20 and the end of the neck 22.

The pump 18, which is of any type known per se, extends axially inside the neck and comprises a lower intake end 28 and an upper dispensing end 30 which protrudes out of the neck. The pump 18 is retained in the neck by means of a metal hoop 32 which is crimped around the neck with a contraction which corresponds to the shape of the shoulder 26.

Figure 2:
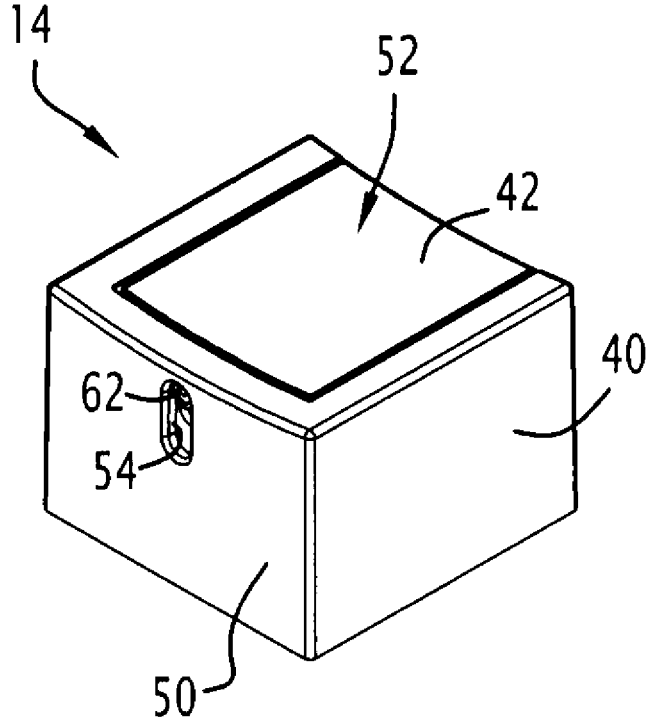
FIG. 2 is a perspective view of the dispensing head of the packaging of FIG. 1.
Figure 3:
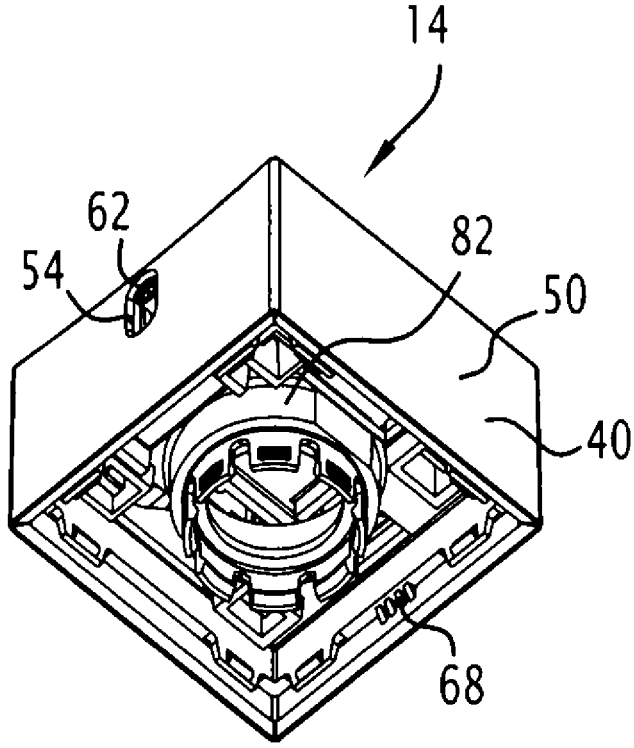
FIG. 3 is a bottom perspective view of the assembled dispensing head before mounting on the bottle.

The dispensing head 14 which can be seen in perspective in FIGS. 2 and 3 comprises a plurality of assembled elements which are illustrated separately in FIGS. 4 to 8. It thus comprises an outer covering 40 inside which there are received in a movable manner an outer push-button 42 and a push-button 44 which are capable of co-operating with the pump 18 and a fixed insert 46 which is mounted on the neck of the bottle by means of a retention ring 48.

As illustrated in FIG. 2, the head has, at the outer side, a generally parallelepipedal shape which is delimited by the outer covering 40. This covering delimits a peripheral cover 50 which is formed by four perpendicular panels in pairs which each extend the flanks of the bottle 12, being flush when the head is mounted on the bottle as illustrated in FIG. 1. The shoulder part 20 comprises a ridge which forms a rectangular peripheral relief having a shape which is compatible with complementary reliefs 51 which are constituted in this instance by flaps which protrude axially from the fixed insert 46 and which thus allow an indexing of the position of the application head and the outer covering 40 thereof relative to the edges of the bottle.

In a variant, the invention can be used, regardless of the shape or the cross-section of the dispensing head and the bottle.

Figure 4:
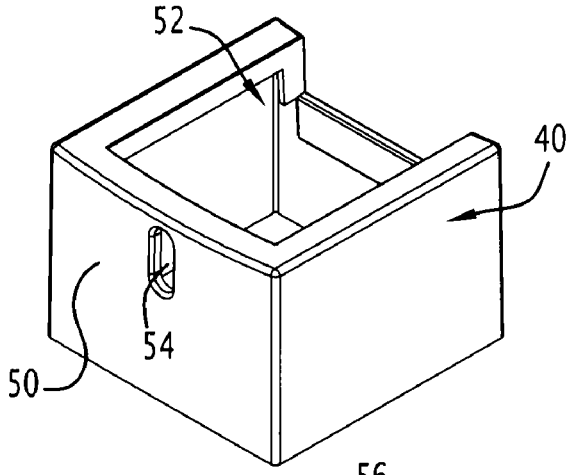
FIGS. 4, 5, 6, 7 and 8 are perspective views of the outer covering, the outer push-button, the push-button, the fixed insert and the ring which are involved in the composition of the dispensing head, respectively.

The outer covering 40 which can be seen alone in FIG. 4 is open at the upper face thereof for access to the outer push-button 42 via an opening 52. It has at the side an opening 54 for passage of the product to be dispensed.

Figure 5:
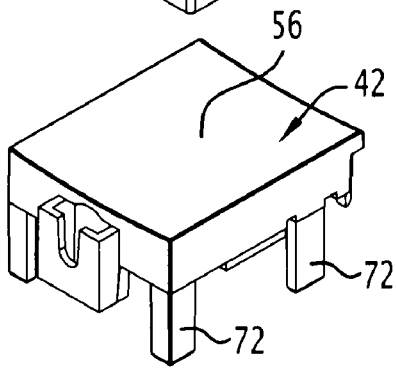

The outer push-button 42 which can be seen alone in FIG. 5 has a generally rectangular shape which delimits an upper abutment surface 56 which can be accessed via the opening 52 and which is capable of receiving a pressing finger of the user.

Figure 6:
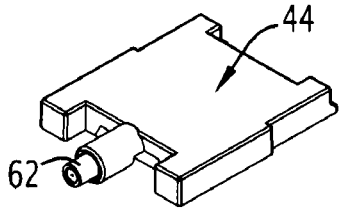

The push-button 44 which can be seen alone in FIG. 6 is interposed between the outer push-button 42 and the dispensing end 30 of the pump. The push-button defines a conduit 60 for conveying the product to be dispensed from the discharge outlet 30 to a release nozzle 62 which is engaged via the opening 54.

Figure 7:
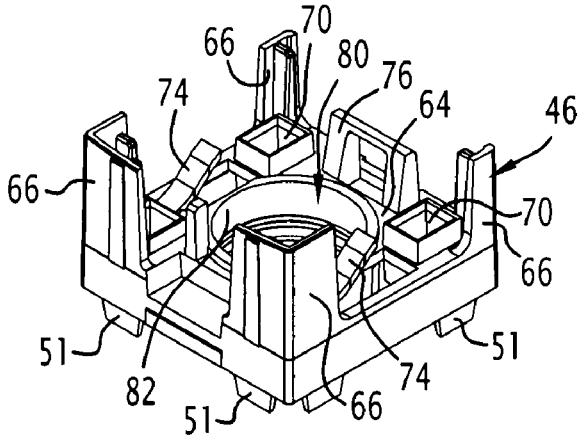

The insert 46 which can be seen alone in FIG. 7 has a generally parallelepipedal base 64 which has, at the four corners thereof, pillars 66 for positioning the outer covering 40 which covers it. The periphery of the base 64 defines a fastening profile for snap-fitting protrusions 68 which are provided on the outer covering 40 and which can be seen in FIGS. 1 and 3. The protrusions allow the outer covering 40 to be retained axially on the fixed insert 46. In the same manner, guide passages 70, which are capable of co-operating with corresponding lugs 72 which protrude from the surface 56 of the outer push-button extend, through the base 64 in order to axially guide it in terms of translation.

Resilient blades 74 protrude from the base 64 and are capable of urging the outer push-button 42 which is in abutment thereon away from the pump 18. The base 64 has a strap 76 which is capable of receiving a retention leg 78 of the outer push-button which can be seen in FIG. 1, the push-button 44 being fixed to the pump 18.

In the central portion thereof, a housing 80 for receiving the ring 48 extends through the base 64 from one side to the other. This passage generally has a circular cross-section and is delimited by a cylindrical skirt 82 which can be seen in FIGS. 1, 3 and 7.

Figure 8:
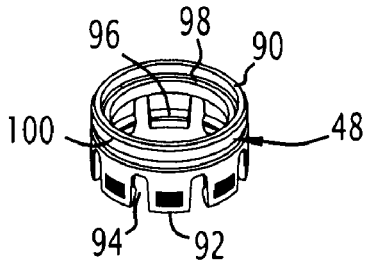

The ring 48 illustrated alone in FIG. 8 has a shape which is generally generated by means of revolution about an axis X-X and has at the outer side a shape which substantially complements that of the reception housing 80. The ring 48 thus has a base crown 90 from which a succession of flaps 92, which form resiliently deformable lugs, extend at the same side and are distributed around the periphery of the crown 90. Each flap extends along a generating line of the cylinder described by the ring. These flaps are separated by recesses 94.

In a variant, the flaps 92, when the ring 48 is isolated, are slightly flared in order to facilitate the mounting and in particular the pre-positioning of the dispensing head on the neck. The flaps may form an angle of between 1° and 15° with the axis X-X.

The flaps 92 are each provided at the free end thereof on the inner surface with a stud 96 which is capable of being in abutment against the rear of the shoulder 26 of the neck. An inner support collar 98 is provided on the inner surface of the ring 48 at a distance from the studs 96 corresponding to the spacing between the shoulder 26 and the upper surface of the pump retained on the neck by means of the hoop 32.

The outer surface of the ring 48 is substantially smooth. It has a peripheral groove 100 which is provided in the crown 90 and which opens at the outer surface thereof. This groove 100 is capable of initially receiving, before mounting the dispensing head on the bottle, an inner retention ring 102 which can be seen in FIG. 9 and which is arranged at the lower end of the shoulder 82 of the insert. This ring which protrudes at the inner surface of the reception housing 80 ensures the initial axial retention of the ring 48 relative to the fixed insert 46 before mounting on the bottle.

Figure 10:
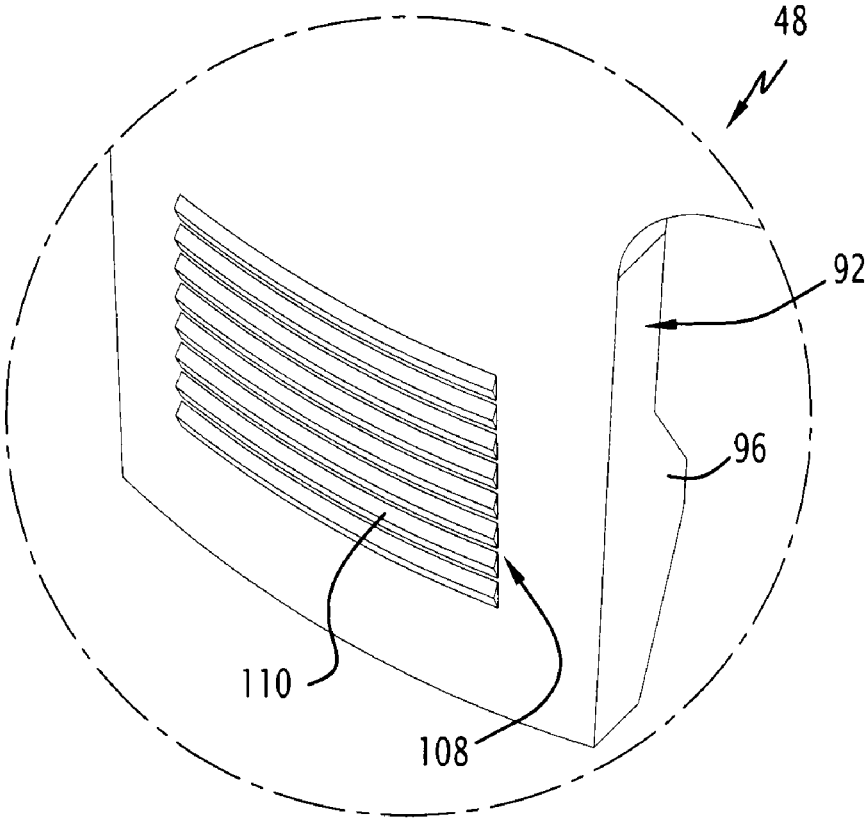
FIG. 10 is an enlarged perspective view illustrating the grooves present on the outer surface of the ring.

Each flap 92 has, on the outer surface thereof which is generally smooth, as illustrated on a larger scale in FIG. 10, multiple grooves 108 which extend horizontally, that is to say, perpendicularly relative to the vertical axis X-X of the bottle 12 and the neck 22. These grooves 108 are delimited by successive ribs 110 which protrude at the generally smooth surface of the flaps 92 which extend parallel with each other and which have, in longitudinal cross-section, a generally triangular shape. This cross-section forms inclined portions which facilitate the passing of the ribs by complementary fastening profiles which will be described below. The grooves of the different flaps are aligned and form rings of discontinuous and parallel grooves.

Figure 11:
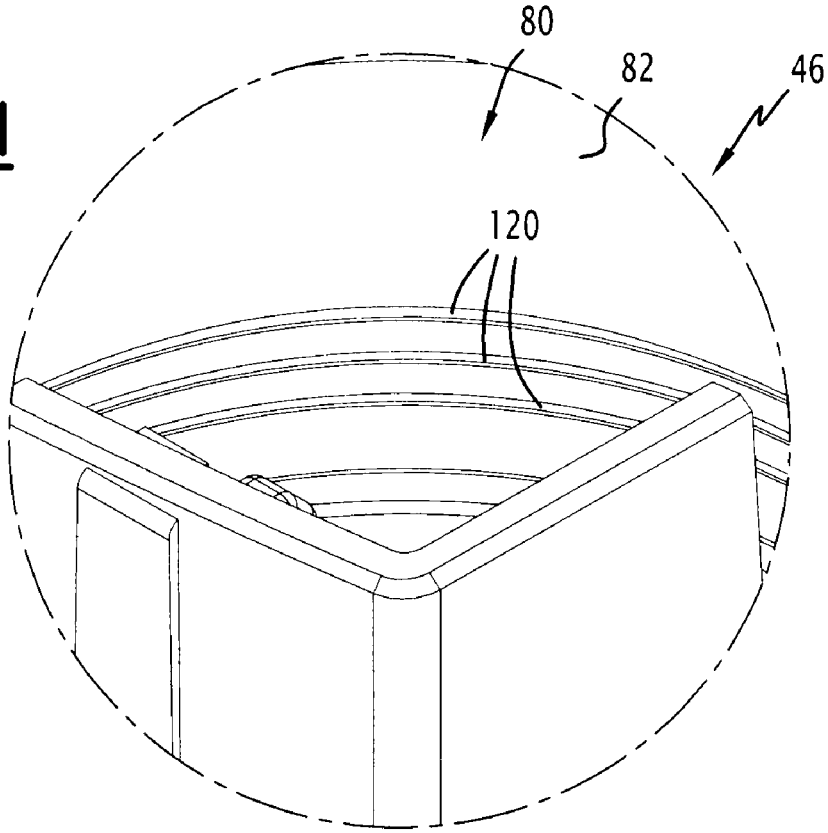
FIG. 11 is an enlarged perspective view of the passage of the fixed insert receiving the ring.

The surface which delimits the housing for receiving the ring of the fixed insert comprises complementary fastening profiles which are constituted by a series of peripheral ribs 120 which can be seen in FIG. 11. These ribs protrude relative to the generally smooth surface of the housing 80. They extend horizontally, that is to say, perpendicularly relative to the axis of the bottle.

The pitch viewed axially separating the grooves 108 and the pitch separating the ribs 120 are multiple integers of each other.

According to the invention, at least two ribs or at least two successive horizontal grooves are arranged on the housing for receiving the ring or on the outer surface of the ring. In the example in question, the number of grooves is seven. This number is preferably between 1 and 30. The number of ribs is at least 1, the number of either the grooves or the ribs being at least two. There are three ribs 120 and the pitch separating them is double that which separates the grooves 108.

In the example in question, the grooves 108 are provided on the resilient flaps 92 and the ribs on the housing 80. In a variant, ribs are provided on the flaps and grooves are provided on the inner surface of the housing.

More generally, any type of complementary protruding and recessed fastening profile can be provided on the ring and on the housing delimited by the insert, if at least two successive profiles which allow the ring to be fastened in at least two axially offset positions are arranged on either the ring or the fixed insert.

Figure 9:
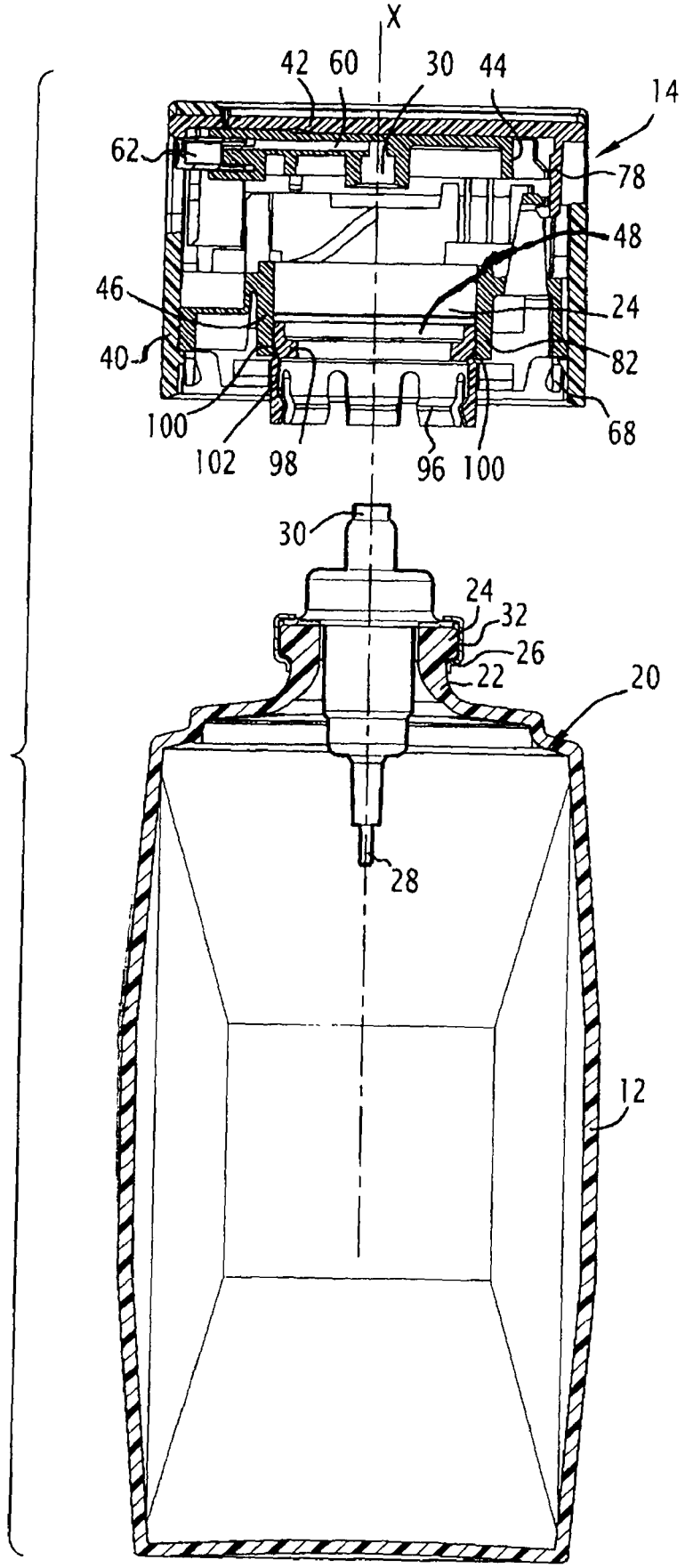
FIG. 9 is a view identical to that of FIG. 1 before mounting the dispensing head on the bottle.

Initially, before mounting on the bottle 12, the assembly forming the dispensing head 14 is preassembled as illustrated in FIGS. 3 and 9. In this position, the flaps of the ring 48 protrude outside the housing 80 of the insert. The ring is retained in this position by the complementary profiles 100 and 102.

Preassembled in this manner, the dispensing head is fitted axially to the bottle which has previously been provided with the pump 18 retained by the hoop 32. The flaps become deformed radially outwards when the ring is engaged around the neck. When the collar 98 is in abutment against the upper surface of the neck, and more precisely at the upper surface of the hoop which retains the pump on the neck, the studs 96 engage below the shoulder 26 thereby ensuring retention of the ring on the neck, the ring surrounding the collar 24.

In order to ensure retention of the ring relative to the insert when the ring is positioned on the neck, the profiles 100 and 102 are sized in order to produce a retention force which is greater than the force required to deform the flaps when the collar 24 is passed.

The axial abutment against the dispensing head is continued, bringing about the disengagement of the retention profiles 100 and 102 so that the ring is progressively covered by the skirt 82. The ring is thus received in the housing 80. The skirt 82 which surrounds the flaps prevents them from becoming deformed. The cover ensures the locking of the mounting on the shoulder 26.

The abutment against the dispensing head is continued until the base of the outer covering 40 moves into abutment against the shoulder part 20, this abutment being without any clearance as illustrated in FIG. 1, and the lateral walls of the head extending the flanks of the bottle 12.

In this position, the protrusions 120 are received in grooves which are defined on the flaps.

Regardless of the displacement travel of the fixed insert which delimits the housing 80 relative to the ring which is immobilised around the neck, at least one fastening profile provided on the insert co-operates with a complementary fastening profile provided on the ring, since a plurality of successive fastening profiles are arranged along the axis X-X, thus allowing compensation for any occurrences of clearance and discrepancies in dimensions between the elements of the head and the bottle resulting substantially from the fact that the bottle is produced from glass and therefore with imprecise manufacturing dimensions.

It will thus be appreciated that a secure connection of the head is obtained in this manner, the ring being retained by means of resilient retention of the ribs in the grooves, whilst allowing an adjustment with no clearance between the dispensing head and the bottle.

This resilient retention of the ribs and the grooves is obtained either by means of the resilience of the flaps 92 or by means of the inherent resilience of the ribs and/or the grooves, or a combination of both.

Owing to the ring according to the invention, production tolerances for the bottles and tolerances for mounting the dispensing member on the bottle are greater, whilst maintaining the appearance since the control member is always moved into abutment against a shoulder of the bottle and thus defines a continuous assembly with no clearance between the control member and the bottle.

Owing to the invention, a supplementary component which absorbs the vertical tolerances of the neck has been provided in order to eliminate the occurrences of stress or tension in this axis. This supplementary component is a ring which comprises fine horizontal retention grooves which make the assembly produced fixed in the ideal position thereof.

These fine horizontal grooves co-operate with at least one complementary groove which is provided on a skirt of the insert which is fixedly joined to the outer covering in which there is retained the assembly which is formed by the outer push-button and the push-button, which are intended to be placed in fluid engagement with a pump body in the examples and the drawings provided.

The ring is supplied pre-mounted in the insert using a retention notch.

After mounting, the assembly continues its travel until it moves into abutment with the glass shoulder, the insert sliding around the ring, constraining it around the crimped cup of the pump, grooves preventing the assembly from rising.

The constraints are contained in the region of the deformable ring. There are no vertical constraints applied to the covering of galvanised ABS, the height tolerance of the neck being absorbed by the travel between the ring and insert.

The invention claimed is:

1. An assembly for a bottle which comprises a neck with a vertical axis, said neck having a shoulder, the assembly comprising:

a ring configured to be engaged around the neck and which includes retention profiles for retention on the neck, said profiles capable of co-operating with the shoulder;

a fixed insert configured to be fitted to the bottle by sliding along the axis of the ring, wherein said fixed insert delimits a housing for receiving the ring; and a control member movable relative to the insert and configured to co-operate with a dispensing member with which the bottle is provided, wherein opposing surfaces of the ring and the housing include complementary protruding and recessed fastening profiles for resilient engagement of the complementary profiles, at least two successive profiles on the ring or the housing allowing the ring to be fastened in at least two positions which are axially offset relative to the housing, wherein the complementary fastening profiles include, on the outer surface of the ring, at least two successive grooves, wherein the retention profiles include flaps distributed at the periphery of the ring and each configured to engage against the shoulder, and wherein the grooves of the ring are discontinuous and extend over the flaps.

2. An assembly according to claim 1, wherein before mounting on the bottle, the ring is engaged in the housing of the insert, and wherein said assembly includes a profile for retaining the ring in position in the insert.

3. An assembly according to claim 1, wherein the complementary fastening profiles include, on the fixed insert, at least two grooves.

4. An assembly according to claim 3, wherein pitches between the grooves of the ring and the insert are multiple integers of each other.

5. An assembly according to claim 1, wherein the grooves are delimited between successive ribs which protrude relative to a generally smooth reference surface.

6. An assembly according to claim 1, wherein the grooves are delimited by inclined flanks which form an inclined portion in accordance with the direction in which the ring is inserted into the insert.

7. A packaging which includes a bottle and an assembly according to claim 1 mounted on the bottle.

8. An assembly for a bottle which comprises a neck with a vertical axis, said neck having a shoulder, the assembly comprising:

a ring configured to be engaged around the neck and which includes retention profiles for retention on the neck, said profiles capable of co-operating with the shoulder;

a fixed insert configured to be fitted to the bottle by sliding along the axis of the ring, wherein said fixed insert delimits a housing for receiving the ring; and a control member movable relative to the insert and configured to co-operate with a dispensing member with which the bottle is provided, wherein opposing surfaces of the ring and the housing include complementary protruding and recessed fastening profiles for resilient engagement of the complementary profiles, at least two successive profiles on the ring or the housing allowing the ring to be fastened in at least two positions which are axially offset relative to the housing, wherein the complementary fastening profiles include, on the outer surface of the ring, at least two successive grooves, wherein the complementary fastening profiles include, on the fixed insert, at least two grooves, and wherein pitches between the grooves of the ring and the insert are multiple integers of each other.

9. An assembly according to claim 8, wherein before mounting on the bottle, the ring is engaged in the housing of the insert, and wherein said assembly includes a profile for retaining the ring in position in the insert.

10. An assembly according to claim 8, wherein the retention profiles include flaps distributed at the periphery of the ring and each configured to engage against the shoulder.

11. An assembly according to claim 10, wherein the grooves of the ring are discontinuous and extend over the flaps.

12. An assembly according to claim 8, wherein the grooves of the ring are delimited between successive ribs which protrude relative to a generally smooth reference surface.

13. An assembly according to claim 8, wherein the grooves of the ring are delimited by inclined flanks which form an inclined portion in accordance with the direction in which the ring is inserted into the insert.

* * * * *